United States Patent [19]

Wallow et al.

[11] Patent Number: 4,716,834

[45] Date of Patent: Jan. 5, 1988

[54] INERTIAL PENETRATOR PROJECTILE

[75] Inventors: Peter Wallow, Duesseldorf; Bernhard Bisping, Ratingen, both of Fed. Rep. of Germany

[73] Assignee: Rheinmetall GmbH, Duesseldorf, Fed. Rep. of Germany

[21] Appl. No.: 765,609

[22] Filed: Aug. 14, 1985

Related U.S. Application Data

[63] Continuation-in-part of Ser. No. 949,067, Sep. 5, 1978, abandoned, and a continuation-in-part of Ser. No. 252,366, Mar. 25, 1981, abandoned.

[30] Foreign Application Priority Data

Mar. 27, 1980 [DE] Fed. Rep. of Germany ..... 3011768

[51] Int. Cl.[4] ..... F42B 11/14

[52] U.S. Cl. ..... 102/519; 102/506; 102/521

[58] Field of Search ..... 102/491–495, 102/485, 501, 506, 514–523

[56] References Cited

U.S. PATENT DOCUMENTS

| | | | |
|---|---|---|---|
| 644,361 | 2/1900 | Luciani . | |
| 1,301,859 | 4/1919 | McKenna et al. | 102/519 |
| 1,312,762 | 8/1919 | Strang . | |
| 1,312,763 | 8/1919 | Strang . | |
| 3,148,472 | 9/1964 | Hegge et al. | 102/703 |
| 3,213,792 | 10/1965 | Grenander et al. | 102/518 |
| 3,545,383 | 12/1970 | Lucy | 102/518 |
| 3,877,380 | 4/1975 | Riparbelli . | |
| 3,916,795 | 11/1975 | Lemstra . | |
| 3,981,246 | 9/1976 | Luther et al. . | |
| 4,108,072 | 8/1978 | Trinks | 102/518 |

FOREIGN PATENT DOCUMENTS

| | | |
|---|---|---|
| 198658 | 12/1957 | Austria . |
| 1194292 | 1/1966 | Fed. Rep. of Germany . |
| 1428679 | 9/1977 | Fed. Rep. of Germany . |
| 128248 | 6/1919 | United Kingdom . |
| 599205 | 7/1946 | United Kingdom . |
| 941524 | 11/1963 | United Kingdom . |
| 1303797 | 1/1973 | United Kingdom . |

*Primary Examiner*—Harold J. Tudor

[57] ABSTRACT

An improved inertial armor-piercing penetrator projectile wherein the axial length of the projectile is a relatively large multiple of its diameter. The projectile includes a pre-penetrator and a main penetrator with a nose and a tail. The forward portion of the main penetrator is operatively connected to the tail of the pre-penetrator. The pre-penetrator comprises a plurality of partial cores which are axially arranged one behind the other and are operatively connected to each other at mutual coupling regions so as to form a stack. The stack of partial cores includes centering and/or fixing means which may take various forms and can be selectively exchanged. The cover and the centering and/or fixing means are adapted to achieve a predetermined fracturing or separation upon the application of a predetermined load. Thus, the centering and/or fixing means include a weakened portion where the fracturing or separation occurs.

The construction and arrangement of the partial cores is such that each partial core differs from the adjacent partial core with respect to dimensions and/or material so that a front partial core will sufficiently disintegrate upon impact prior to the next following partial core reaching the target.

17 Claims, 12 Drawing Figures

INERTIAL PENETRATOR PROJECTILE

CROSS-REFERENCE TO RELATED APPLICATION

This application is a continuation-in-part of applications Ser. Nos. 949,067 and 252,366, filed, respectively, on Sept. 5, 1978 and Mar. 25, 1981, both now abandoned, and entitled respectively INERTIAL PROJECTILE AND INERTIAL PENETRATOR PROJECTILE WITH A STACK-SHAPED PRE-PENETRATOR.

BACKGROUND OF THE INVENTION

The instant invention has as an object to improve the projectiles disclosed in our copending patent application. Such projectiles have a large lengths to diameter ratio. The expression "large length to diameter ratio" is explained in U.S. Pat. No. 4,075,946. More specifically the individual partial cores are connected to each other and to the main penetrator in such a way, that even with armored targets having several plates, particularly with those multi-plate armored targets where adjoining plates are spaced at substantial distances from each other, for example, those armored targets which include multiplated ceramic modules of different substances, they are penetrated by the inertial projectiles of the invention.

This improved penetration is based on providing a reduction of basic material from front to rear, which extends substantially along the entire penetration path along a longitudinal axis; thereby a premature termination of penetration, for example due to breaking off or disintegration of the main penetrator, does not occur. It is to be understood that, in comparison to a monoblock integral penetrator, the reduction of basic material front to rear is such that, on the one hand, there is "consumed" a forwardly disposed partial core of the pre-penetrator possibly per plate of the target, whereby this partial core, on the other hand, disintegrates in sufficiently small broken parts, so that these broken parts do not represent a disturbing obstacle for the next following part of the penetrator.

BRIEF DESCRIPTION OF THE DRAWINGS

Other objects and advantages of the invention will appear from the following detailed description of a preferred embodiment thereof, reference being made to the accompanying drawings, in which.

DESCRIPTION OF THE PREFERRED EMBODIMENTS

Figure 1:
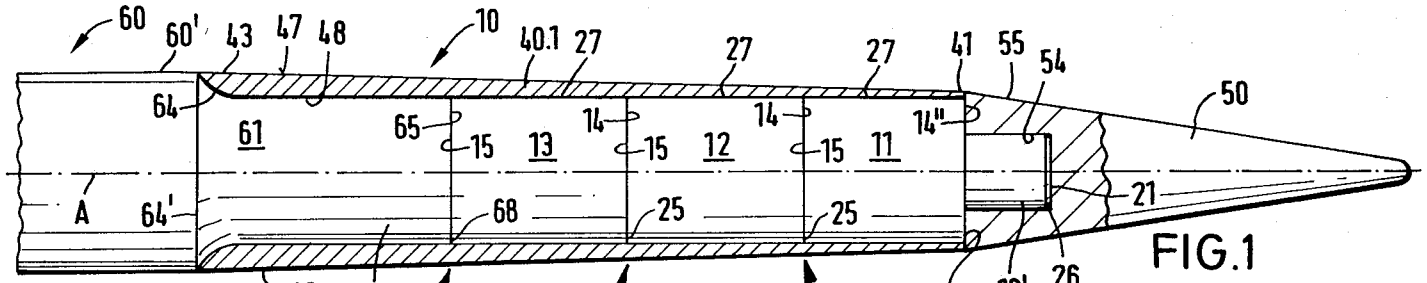
FIGS. 1 to 6 are longitudinal schematic axial sectional views of six different embodiments of the invention.

According to FIG. 1 there is disclosed in the first embodiment of the invention a pre-penetrator 10 in front of which a nose 50 is mounted, which pre-penetrator consists of three partial cores 11, 12 and 13, of equal diameter. Butt joined circular end faces 14 and 15 of the partial cores 11, 12 and 13 form a first and second coupling region C1 and C2. The main penetrator 60 is provided with a forward portion 61 which has substantially the same outer diameter as the afore-described partial cores; a forwardly facing end face 65, forms the forward end of a pointed portion 62, which adjoins as a butt joint with the rear end face 15 of the partial core 13 and forms therewith a third coupling region C3. A cover 40.1 extends from a forward point region 41, which is substantially in the vicinity of an annular end surface 14" of the most forward partial core 11, to a rear circular region 43 which is in the immediate vicinity of a peripheral tapered outer surface 64 of the forward portion 61 of the main penetrator 60. The cover 40.1 has, along its entire longitudinal extent, the same inner clear diameter, whereas the wall of the cover 40.1 increases in thickness from its forward to its rear end. An axial pin 19' extends from the front annular end surface 14" of the most forward partial core 11. It is tightly mounted, for example by means of a press of shrink fit, inside a blind axial bore 54 of the nose 50. The peripheral surfaces 27 of the partial cores 11, 12 and 13 as well as the peripheral surface 63 of the point region 62 of the forward portion 61 of the main penetrator 60 also form a closed surface as does the peripheral surface 55 of the nose 50, the peripheral surface 47 of the cover 40.1 and the peripheral surface 60' of the main penetrator 60. They join together in the vicinity of edge 64' of the tapered surface 64. The frontal end faces 14 and 14" of the partial cores 11, 12 and 13 are limited on their external side by means of sharp edge borders 25. Furthermore, a frontal end face of the pin 19' has a sharp edge border 26 and the end face 65 of the forward portion 61 of the main penetrator 60 has a sharp edge border 68. The partial cores 11, 12 and 13 of the pre-penetrator 10 as well as the main penetrator 60 consist of a material of high density. The afore-mentioned feature of equal diameters of the partial cores 11, 12 and 13 together with the point region 62 of the front part 61 of the main penetrator 60 favor advantageously the employment of a simple manufacturing process for the assembly. When selecting the material for the cover 40.1 one has to consider in addition to an achievement of the afore-described object of the invention, as a governing task to achieve as high as possible an average density. The cover 40.1 can be shrink-fitted on to the partial core 11; additionally also, however, to the partial cores 12 and 13 as well as to the forward portion 61. In order to achieve the adaptation of the assembly to the afore-described object, the partial cores can be preselected according to their length and/or material and/or structure; moreover, the adherence values between the confronting peripheral surfaces 27 and 63 as well as the inner surface 48 of the cover 40.1 can be selectively adjusted and by selecting and constructing the corresponding coupling regions C . . . and/or providing fracture points for the resistance moment against breaking, which increases from the front to the rear between predetermined limits, the object of the invention can be achieved. An aluminum alloy has been found suitable for the material for the nose 50. Whereas in the illustrated embodiment there are included three partial cores 11, 12 and 13, and whereby the partial cores 12 and 13 are of equal lengths, and the partial core 11 is shorter by a predetermined difference, the length of the parallel cores as well as the number thereof (and thereby also the number of coupling regions C . . . ) can vary from the embodiment as illustrated in FIG. 1.

Figure 2:
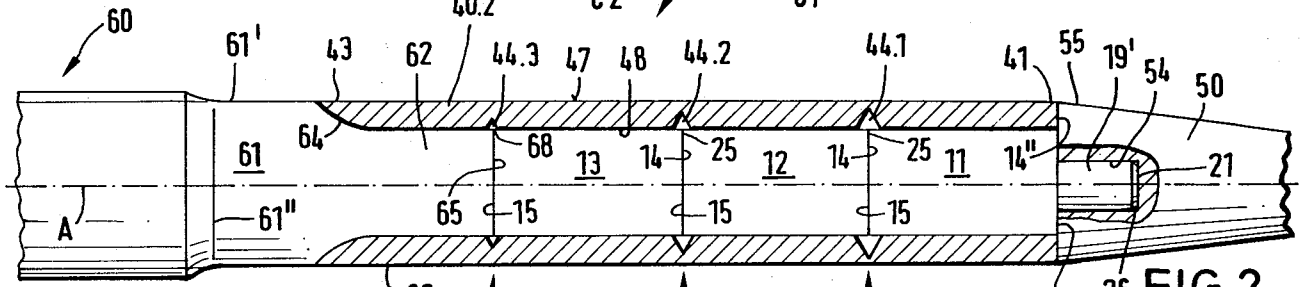

The pre-penetrator 10 of the inertial projectile in accordance with FIG. 2 exhibits over its length between the front region 41 and its rear tapered region 61", a uniformity of diameters of the partial cores 11, 12 and 13 and as well the point region 62 of the forward portion 61. Thereby there is also provided a substantially uniform wall thickness for the cover 40.2. The axial decrease of material, in accordance with the object of the invention, is implemented in this embodiment by means of the fracture lines disposed in the coupling regions C . . . The latter are embodied by means of ring-shaped triangular grooves 44 . . . The description set forth in connection with the embodiment of FIG. 1 relating to the partial cores 11, 12 and 13 and their connections with the cover 40.2 as well as relating to the material for the nose 50 also pertain to the embodiment of FIG. 2.

Figure 3:
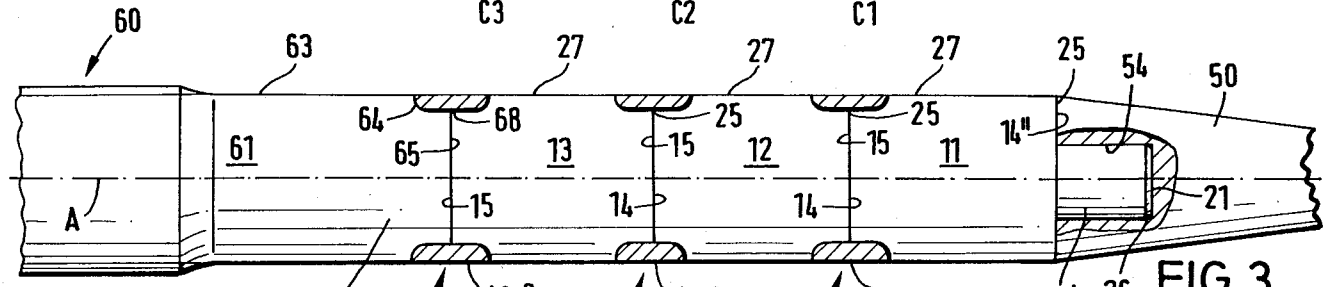

In the embodiment of FIG. 3 the cover takes the form of a plurality of ring-shaped members 40.8, each of which overlaps the corresponding coupling region C . . . in the region of their peripheral surfaces 27 and 63. The ring-shaped members 40.8 are of substantially identical dimensions; they can distinguish from each other by the material from which they are made, so that the resistance moment against fracturing of the partial cores 11, 12 and 13 of the pre-penetrator 10 increases from the coupling region C.1 to the further rearwardly disposed coupling regions C . . .

Figure 4:
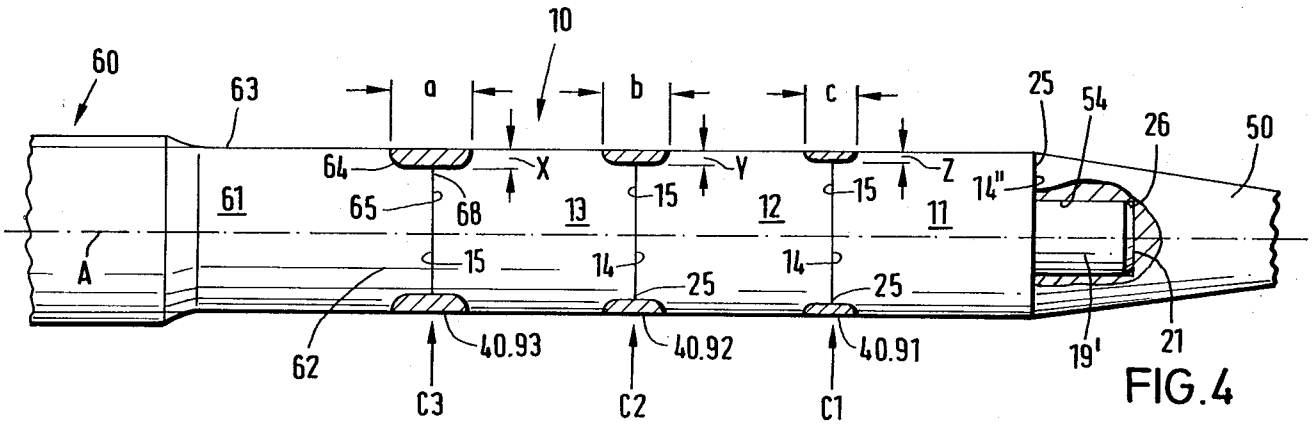

The last-mentioned feature of the embodiment of FIG. 3 can be achieved in the somewhat similar embodiment of FIG. 4, wherein ring-shaped members or sections 40.91 to 40.93 are provided, which are made out of identical material but have correspondingly decreasing wall thicknesses x, y and z and decreasing lengths a, b and c. In this way there is taken into account the fact that upon impacting a hard plate target the butt adjoining surfaces confronting each other in the respective coupling regions C . . . form a respective axial distance between each other. It was observed, that this axial distance stepwise increases peripherally from the foremost coupling region to the subsequent coupling regions up to about 5 mm.

Figure 5:
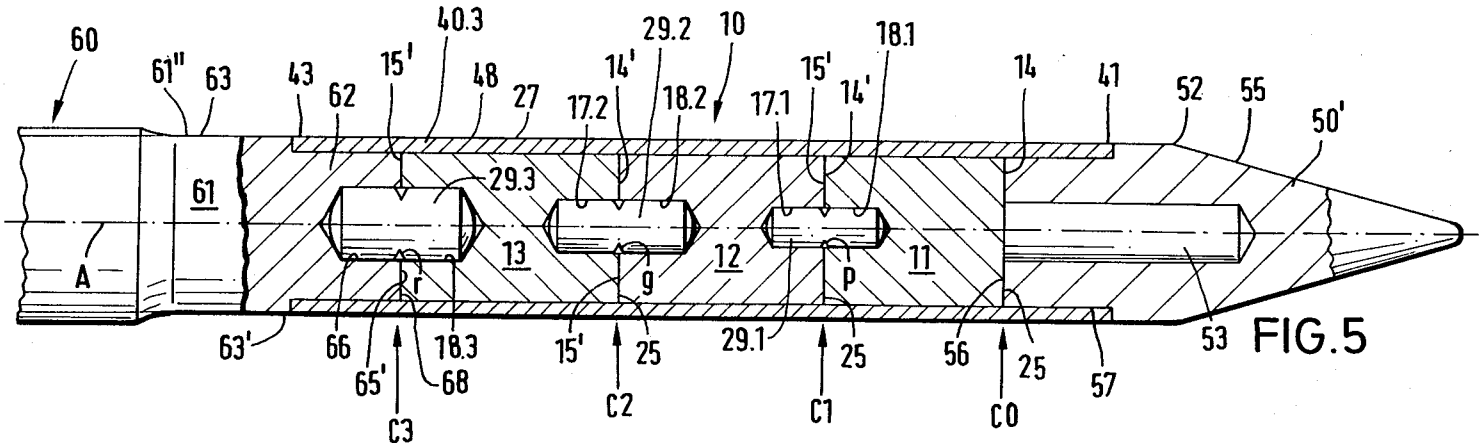

In the embodiment of FIG. 5 the pre-penetrator 10 has a uniform exterior diameter between the region adjoining the nose of the projectile and a region 61" disposed rearwardly therefrom. The partial cores 11, 12 and 13 of the pre-penetrator 10 exhibit with respect to each other and with respect to the forward portion 61 of the main penetrator 60 a heterogeneous pin coupling. In blind bores 17.1 . . . and 18.1 . . . disposed in confronting faces of adjoining partial cores there are disposed respective pins 29.1 . . . , whose length and diameter stepwise progressively increases from the coupling regions C1 to the coupling C3. The pin 29 . . . can be selectively provided with fracture lines of points p, g and r. A cover 40.3 of uniform inner and outer diameter extends longitudinally from the forward region 41 adjoining the nose 50' to the region 43 disposed in the point region 62 of the forward portion 61 of the main penetrators 60. In distinction to the previously described embodiments, the inertial projectile of the embodiment of FIG. 5 has a nose 50' which is made out of a preselected steel alloy. A blind bore 53 extends from an annular end surface 56 towards the point of the projectile past the region 52. The surface 57 extending around the periphery of the cylindrical portion of the nose 50', serves to receive the forward end of a cover 40.3 to couple the nose 50' with the partial core 11. The axial reduction of material in the afore-described embodiment can be influenced by selecting appropriate dimensions and/or material for the pins 29.1, 29.2 and 29.3 as well as providing selectively fracture lines or regions p, q and r and a predetermined surface pressure between the respective pins 29 . . . and walls of the bores 17 . . . and 18 . . . and the peripheral surfaces 27 and 63' with the inner surface 48 of the cover 40.3. By means of coupling the nose 50' with the first partial core 11 a further coupling region CO is formed.

Figure 6:
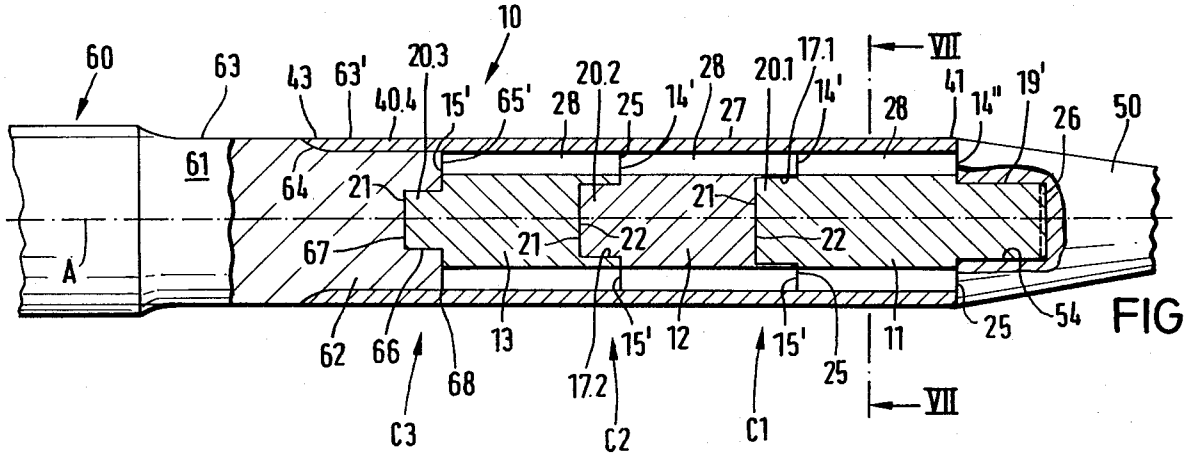
Figure 7:
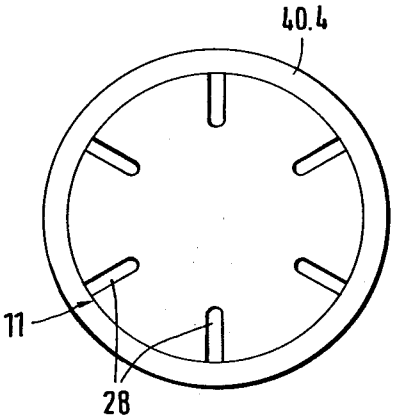
FIG. 7 is a cross-sectional view, at an enlarged scale, along line VII—VII in FIG. 6.

In the embodiment of FIG. 6 the pre-penetrator 10 has a cover 40.4. This cover is of uniform diameter and has a uniform wall thickness and extends from the forward region 41 adjoining the nose of the projectile to the rear region 43 in the vicinity of the tapered surface 64 on the forward portion 61 of the main penetrator 60. The point region 62 is of the same diameter as the partial cores 11, 12 and 13, whereas the partial cores differentiate themselves from each other by their lengths. At the forward-most partial core 11 there extends again forwardly past the forward-mosts angular surface 14" a pin 19' for fixing thereon the nose 50 made out of a light metal alloy. At its back or rear side the partial core 11 is formed as a pin 20.1. This pin 20.1 engages in a front blind bore 17.1 of the partial core 12. This partial core 12 is also turned at its rear side so that a pin 20.2 is formed which extends past the annular surface 15' into a forward-facing blind bore 17.1 of the partial core 13. Finally, the partial core 13 is turned at its backside so as to form an axial pin 20.3 extending past the annular surface 15 engaging into a bore 66 in the point region 62 of the main penetrator 60. In the coupling region C . . . there is provided a coupling formed by the cover 40.4 as well as the afore-mentioned homogeneous pin connections. All partial cores exhibit, as can be noted from FIG. 7, exterior, radial longitudinal slots 28. By means of this construction there also is provided, in view of the stepwise reduction of diameters from pin 20.1 to pin 20.2 to pin 20.3, the desired longitudinal decrease of material, which is preselected in such a way that the partial cores 11, 12 and 13 are respectively disintegrated in sufficiently small fractured pieces, so that none of these fractured pieces represent a disturbing obstacle for the next following portion of the penetrator.

Figure 8:
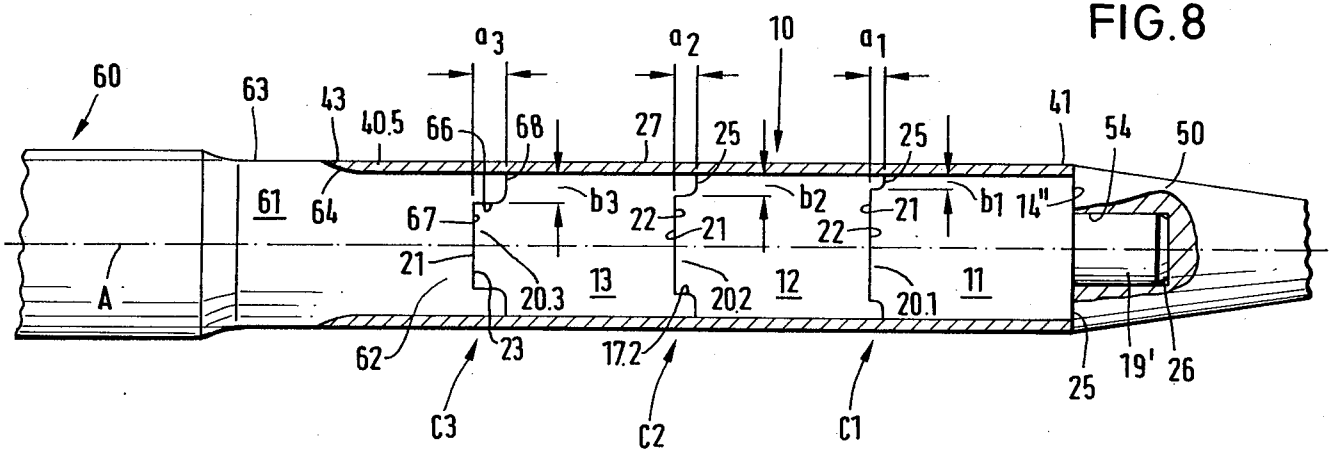
FIGS. 8 and 9 are longitudinal axial sectional schematic views of two additional embodiments of the invention.

As a modification of the embodiment of FIG. 6, the embodiment of FIG. 8 also has a pre-penetrator 10, the partial cores 11, 12 and 13 of which are coupled homogeneously to each other and to the forward position 61 of the main penetrator 60. By means of differentiating the frontal bores 17.1, 17.2 and 66 according to depth and diameter, covers are formed in the peripheral region, the radial extent of which continuously increases from $b_1$ via $b_2$ to $b_3$ and whose axial extent also increases from $a_1$ via $a_2$ to $a_3$. The rearward projections 20 . . . of the partial cores 11, 12 and 13 are also, with respect to the peripheral surface pressure, constructed in accordance with the objects of the invention. Also with respect to the relationship between the cover 40.5 and the elements enclosed by it, there also applies what has been described in connection with the other described embodiments of the invention.

Figure 9:
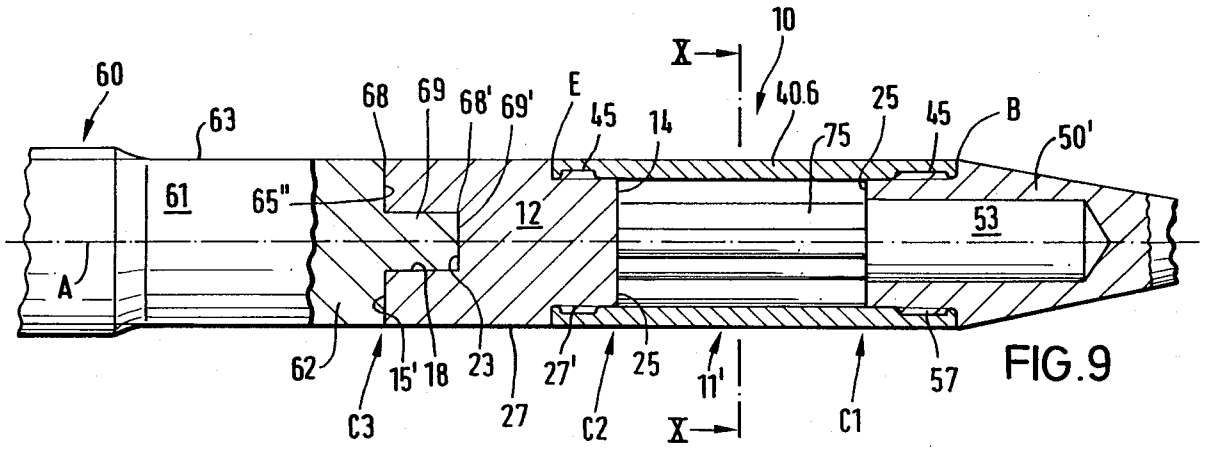
Figure 10:
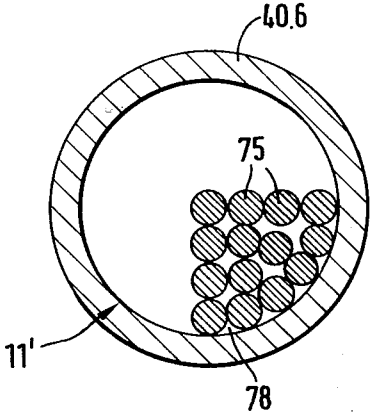
FIG. 10 is a cross-sectional view along line X—X in FIG. 9 at an enlarged scale.
Figure 11:
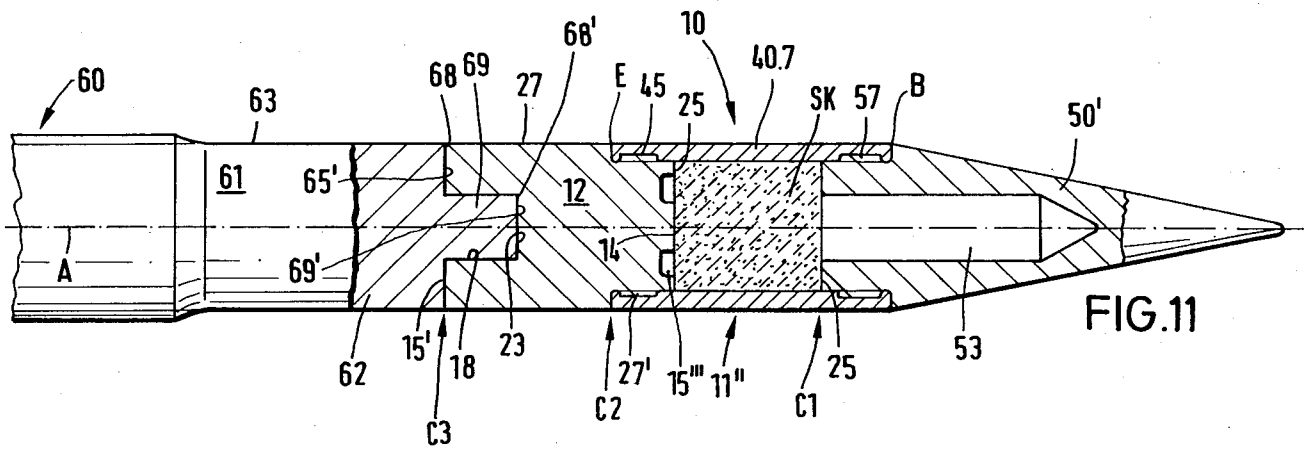
FIGS. 11 and 12 illustrate schematically in longitudinal axial sectional view the last two embodiments of the invention.

While the heretofore described embodiments include a difference between the individual partial cores 11, 12 and 13, which substantially was restricted to the dimensioning (disregarding the not expressly explained but mentioned differences in material making up the individual cores) the embodiments of FIGS. 9, 10 and 11 describe two examples in which a partial core does basically differentiate itself from the other(s) core(s) with respect to structure and material. The first partial core 11' (FIGS. 9 and 10) consist of a tightly packed bundle of hard metal rods 75, which are cast in place by means of a cast resin which is designated with the reference 78 and is disposed in the interstices between the hard metal rods 75. In view of its high density, lead can also be used in lieu of the cast resin. A cover 40.6 holds the bundle of rods together. The ends B and E overlap a turned part 57 adjoining the nose 50' and the turned part 27'0 of the partial core 12. For coupling purposes, which have not been described in detail, the cover has in the regions B and E inner turned indentations 45. At both sides of the bundled rods of the forward partial core 11' there result the coupling regions C1. and C2. A third homogeneous coupling region C3 results from a homogeneous coupling region between the projection of the forward portion 61 of the main penetrator 60 which matingly fits into the blind axial bore 18 disposed at the backside thereof. This blind bore 18 provided with a bottom surface 23, and the blind bore 18 is also defined by an annular surface 15'. The afore-described projection of the forward portion 61 is designated as a pin 69 which is relatively easily separated from the remainder of the forward portion 61 and is defined by an annular surface 65". The embodiment of FIG. 11 differentiates itself from the embodiment of FIGS. 9 and 10 in the different construction of the intermediate core 11". This intermediate core is surrounded with a cover 40.7 and forms a very brittle body made of a high-density heavy-ceramic SK material. The adjoining contracting surface 14 of the partial core 12 is provided with turned indentations 15'41 . By means of these indentations the transfer of the shock waves, which results upon impacting on the target, impact effect is reduced, and could even be completely avoided, since the brittle body disintegrates at firing.

Figure 12:
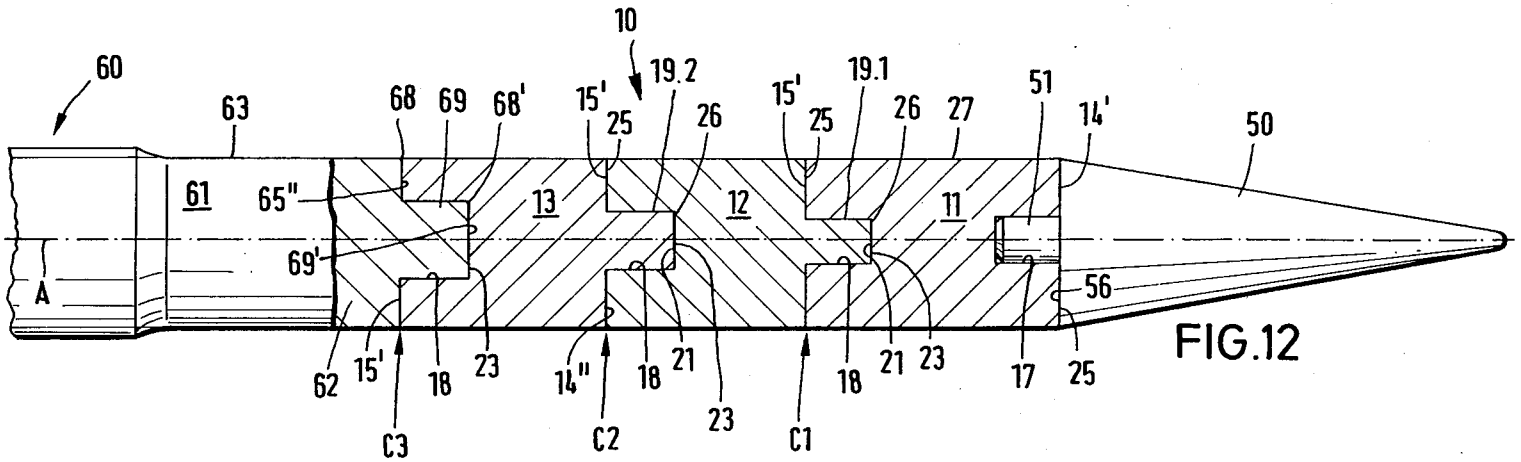

The embodiment according to FIG. 12 illustrates a prepenetrator with a purely homogeneous pin-bore connection. In the rear blind bore 18 of the partial core 11 there engages the pinprojection 19.2 of the partial core 13. A pin-projection 69 which axially extends forwardly past the front annular surface 65" of forward portion 61 of the main penetrator 60. This pinprojection 69 matingly fits into the rear-facing blind bore 18 of the partial core 13. The nose 50 is made out of an aluminum alloy and has a rearwardly extending pin 51 extending axially rearwardly past the rear-facing annular surface 56' into a frontfacing blind bore 17 of the partial core 11. The diameters of the homogeneous pins 19.1 to 69 substantially stepwise increase from coupling region C1 to coupling region C3. For the mutual surface contacting of the bin-pore connections the descriptions set forth concerning corresponding connections of the other embodiments apply also.

The combination of features forming part of the aforedescribed embodiments result in the solution and attainment of the objects set forth in the introductory portion of the specification, namely that, upon impacting an armored multi-plate target, the inertial projectile of the invention, as set forth in the various embodiments, provides a reduction of material along the various embodiments, provides a reduction of material along a longitudinal axial direction away from the target that is from its nose to its tail section. Thereby the partial cores disintegrate into sufficiently small fractured pieces; large fractured pieces from a forward region of the projectile have been found to form obstacles for the subsequent parts of the projectile for purposes of penetrating the target.

For reasons other than simplification of the construction, the nose 50, 50' can also be provided with a fine threaded portion which threadably engages with the adjoining region, for example, 41, respectively B, of the respective cover 40.1 . . . , so that in the corresponding region also the notch-effect (fatigue stress concentration) of the threaded parts favors the desired fracturing effect.

In order to achieve the desired effect on the corresponding target other embodiments of inertial projectiles and combinations of features are possible. Consequently, all of the aforedescribed features are to be considered as part of the invention.

Although the invention is illustrated and described with reference to a plurality of embodiments thereof, it is to be expressly understood, that it is in no way limited to the disclosure of such preferred embodiments, but is capable of numerous modifications within the scope of the appended claims.

We claim:

1. An improved inertial armor-piercing subcaliber penetrator projectile, having a relatively large length to diameter ratio, and including a front pre-penetrator having a nose and a tail, and having a main penetrator operatively connected to said tail of said pre-penetrator, said pre-penetrator comprising a stack of predetermined mass of a predetermined number of partial cores, each partial core being of predetermined length and having an essentially circular cross-section of uniform corresponding diameter, a front end surface, and an aft end surface, each partial core being separable from the stack of partial cores and being exchangeable for an other partial core of different mass, each partial core having at least one sharp edge on its front region, the front end surface of each partial core abutting the aft end surface of the immediately adjacent partial core to thereby form a predetermined number of butt zones, the major portion of each of two corresponding abutting surfaces of each butt zone defining a plane which is normal with respect to the central longitudinal axis of said penetrator, each butt zone comprising centering means to fixedly connect adjacent partial cores to each other, said centering means provide a predetermined fracturing or separation upon the application of a predetermined load, each butt zone forming an individual preset fracturing area, the predetermined load to be applied to achieve said fracturing or separation in said area stepwisely increasing from the front-most butt zone to the one next rearwardly disposed up to the front end of said main penetrator.

2. The improvement in an inertial armor-piercing penetrator projectile as set forth in claim 1, wherein each of said partial cores are of predetermined construction along its length and cross-section and the stack is arranged so that adjacent partial cores differ from each other with respect to dimensions.

3. The improvement in an inertial armor-piercing penetrator projectile, as set forth in claim 1, wherein said centering means include a cylindrical cover, each one of said partial cores is connected to an adjacent partial core via a coupling region, said cover extending over one part of a partial core and at least its adjoining coupling region and over one part of the adjacent partial core.

4. The improvement in an inertial armor-piercing penetrator projectile, as set forth in claim 3, wherein said cover has a uniform cylindrical wall thickness.

5. The improvement in an inertial armor-piercing penetrator projectile, as set forth in claim 3, wherein said cover has a front region and a rear region, the wall thickness of said cover increasing continuously from said front region to said rear region while the internal diameter remains constant.

6. The improvement in an inertial armor-piercing penetrator projectile, as set forth in claim 3, wherein said coupling regions are provided with fracture lines.

7. The improvement in an inertial armor-piercing penetrator projectile, as set forth in claim 6, wherein said fracture lines are in the form of annular grooves.

8. The improvement in an inertial armor-piercing penetrator projectile, as set forth in claim 7, wherein the depth of said annular grooves decreases as their distance from the nose of the stack increases.

9. The improvement in an inertial armor-piercing penetrator projectile, as set forth in claim 1, wherein said centering means is formed of a plurality of ring portions, each of said partial cores is connected to an adjacent partial core or to the nose via a coupling region, each ring portion extends axially only over a corresponding coupling region.

10. The improvement in an inertial armor-piercing penetrator projectile, as set forth in claim 9, wherein said ring portions increase in axial length and thickness as their axial distance from the nose increases.

11. The improvement in an inertial armor-piercing penetrator projectile, as set forth in claim 10, wherein adjacent partial cores are connected to each other at their coupling regions, the confronting axial surfaces of said partial cores being provided with axial blind bores and a pin being disposed in each pair of confronting blind bores, said confronting pair of blind bores and pin constituting a heterogeneous pin connection at each coupling region.

12. The improvement in an inertial armor-piercing penetrator projectile, as set forth in claim 10, wherein adjacent partial cores are connected to each other at their coupling regions, each adjoining part of partial cores having a pair of confronting axial surfaces, one surface of said pair having an axial pin projection and the other surface having a mating blind bore, said pin projection and blind bore constituting a homogeneous pin connection at each coupling region.

13. The improvement in an inertial armor-piercing penetrator projectile, as set forth in claim 12, wherein said pin projections and mating blind bores increase in length as their distance from the nose increases.

14. The improvement in an inertial armor-piercing penetrator projectile, as set forth in claim 11, wherein said pins and confronting blind bore increase in diameter as their distance from the nose increases.

15. The improvement in an inertial armor-piercing penetrator projectile, as set forth in claim 13, wherein said pin projections stepwise decrease in diameter as their distance from the nose increases.

16. The improvement in an inertial armor-piercing penetrator projectile as set forth in claim 1, wherein each of said partial cores are of predetermined construction along its length and cross-section and the stack is arranged so that adjacent partial cores differ from each other with respect to material.

17. The improvement in an inertial armor-piercing penetrator projectile as set forth in claim 1, wherein said centering means include a cylindrical cover, each one of said partial cores is connected to an adjacent partial core or to the nose via a coupling region, said cover extending at least over one partial core and at least one of its adjoining coupling regions.

* * * * *